US006112751A

United States Patent [19]

Bennett

[11] Patent Number: 6,112,751

[45] Date of Patent: Sep. 5, 2000

[54] HAIR STYLING COMB

[75] Inventor: Steven Bennett, Blaby, United Kingdom

[73] Assignee: Komb Limited, United Kingdom

[21] Appl. No.: 09/308,033

[22] PCT Filed: Nov. 12, 1997

[86] PCT No.: PCT/GB97/03092

§ 371 Date: May 12, 1999

§ 102(e) Date: May 12, 1999

[87] PCT Pub. No.: WO98/20771

PCT Pub. Date: May 22, 1998

[30] Foreign Application Priority Data

Nov. 12, 1996 [GB] United Kingdom ..... 9623461

[51] Int. Cl.[7] ..... A45D 24/22

[52] U.S. Cl. ..... 132/116; 401/179

[58] Field of Search ..... 132/116, 112, 132/113, 114, 115; 401/179, 28

[56] References Cited

U.S. PATENT DOCUMENTS

| | | | |
|---|---|---|---|
| 2,028,588 | 1/1936 | Carson | 132/125 |
| 2,127,794 | 8/1938 | Wastman | 401/179 |
| 2,218,471 | 10/1940 | Hickey | 132/112 |
| 2,278,811 | 4/1942 | Wallenius | 132/116 |
| 2,446,398 | 8/1948 | Wilson | 132/116 |
| 3,079,628 | 3/1963 | Wright | 401/179 |
| 3,818,917 | 6/1974 | Hudson . | |
| 4,516,591 | 5/1985 | Hierholzer | 132/116 |
| 4,566,472 | 1/1986 | Mueller et al. . | |
| 4,605,026 | 8/1986 | Nolin . | |
| 4,727,893 | 3/1988 | Goncalves . | |
| 5,024,243 | 6/1991 | Snyder . | |
| 5,059,050 | 10/1991 | Guglielmo | 132/116 |
| 5,060,679 | 10/1991 | Christopher et al. . | |
| 5,337,764 | 8/1994 | McKay . | |
| 5,482,058 | 1/1996 | Garconnet . | |

FOREIGN PATENT DOCUMENTS

| | | | |
|---|---|---|---|
| 2595218 | 9/1987 | France | 132/116 |
| 444008 | 12/1935 | United Kingdom . | |
| 553912 | 6/1943 | United Kingdom . | |

*Primary Examiner*—Todd E. Manahan
*Attorney, Agent, or Firm*—Young & Basile, P.C.

[57] ABSTRACT

A hairstyling comb particularly useful for applying streaks of highlighter to the hair comprises a hollow stem closed at one end and communicable at its other end with a reservoir of a viscous liquid to be applied to the hair. Discrete passageways are spaced along the length of the stem whereby its interior opens to discrete locations near the junctions between respective pairs of teeth of the comb. Concavities open generally laterally of the comb, each communicating with a respective one of said passageways and having a relatively greater cross-sectional area.

5 Claims, 3 Drawing Sheets

HAIR STYLING COMB

Figure 1:
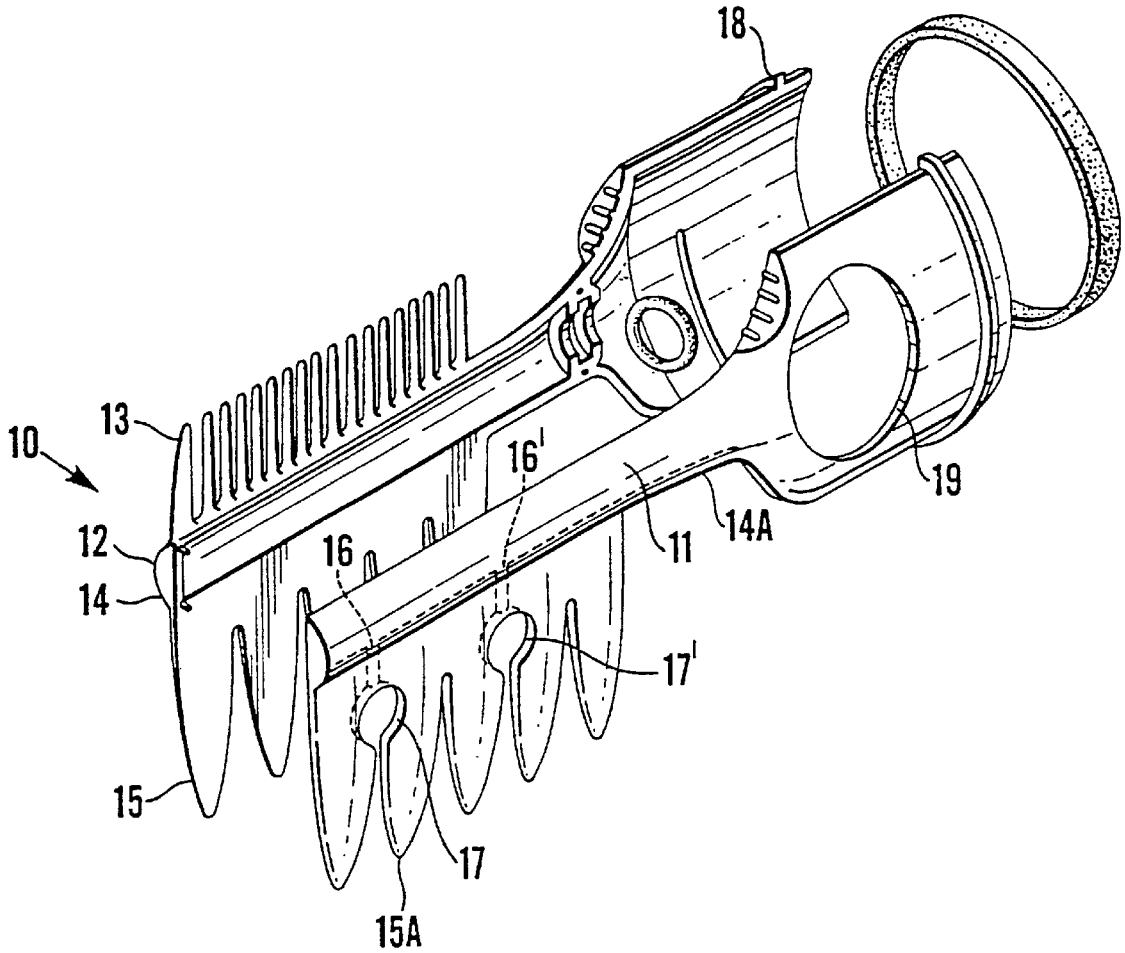

This invention relates to a comb for use in hairstyling operations which involve the application of liquids, particularly viscous liquids, to the hair.

Conventionally gels, dies, conditioners and the like are dispensed onto the palm of the hand and rubbed into the hair before combing it. This is obviously a messy and inconvenient operation for the hairdresser. Highlighting has been carried out by applying streaks of highlighting gel directly from its container before combine the hair. Again this is an operation in which the hairdresser is likely to soil his hands and it is difficult to control the amount and therefore the spread of the gel applied.

GB-A-444,008 and GB-A-553,912 each disclose combs specially designed to retain viscous liquids in reservoirs between or formed in the teeth. These combs have the advantage that sufficient quantities of a treatment liquid can be retained by the comb to avoid continually dipping the comb, but because the reservoirs can only be charged by dipping the whole comb the liquid is present over the whole length of the comb and not only at selected positions along its length. Too much liquid will be present and these combs are not suitable for the application of highlighting liquids which are to be confined to discrete streaks through the hair.

Avoidance of wetting the whole comb and confining liquid to reservoirs between or in the teeth is aimed at by U.S. Pat. No. 4,566,472. The comb is laid on a template which charges only well formations in the teeth. Clearly this is a time consuming and not particularly easy operation.

U.S. Pat. No. 5,024,243 and U.S. Pat. No. 5,482,058 exemplify prior art proposals for liquid-applicator combs in which the hollow interior of the root of the comb communicates with spaces between adjacent teeth by means of narrow side or capillary passages. Because very little liquid will be exposed at the open end of each of these passages in order to apply the liquid evenly the operator must maintain a carefully controlled pressure to force liquid out of the passages at the appropriate rate.

A principal object of the present invention is to improve upon prior art proposals by providing a comb which combines advantages of previously known combs while at the same time being easier to use and more reliable in its operation. It is another object of the invention to achieve this with a comb of simple construction which is economical to manufacture and will remain reliable in use.

In accordance with the invention a hairstyling comb comprises a hollow root or stem communicable with a reservoir of a viscous liquid to be applied to the hair, discrete passageways spaced along the length of the root or stem whereby its interior opens to discrete locations near the junctions between respective pairs of teeth of the comb, and concavities of the root or stem opening generally laterally of the comb, each conmunuicating with a respective one of said passageways and having a relatively greater cross-sectional area.

In preferred constructions one end of the stem is closed and the other end is adapted for releasable connection to said reservoir, the latter serving also as a handle for the comb when attached to the stem.

Plunger or trigger means may be associated with the reservoir whereby its interior may be pressurised to expel the liquid into the stem, and the plunger or trigger may be positioned so that the forefinger of a hand holding the reservoir may be used to depress the plunger or trigger.

Alternatively the stem may have an open end which is telescopically received in a tubular formation of the reservoir, the stem having limited movement relative to the reservoir between a position in which communication of the interior of the stem with the interior of the reservoir is closed off and a position in which a passageway is opened for the flow of fluid from the interior of the reservoir to the interior of the stem.

Each concavity is preferably formed in root portions of a respective pair of adjacent teeth and the teeth of each pair in which a concavity is formed may be more widely separated in their communicating with the well therein.

Figure 2:
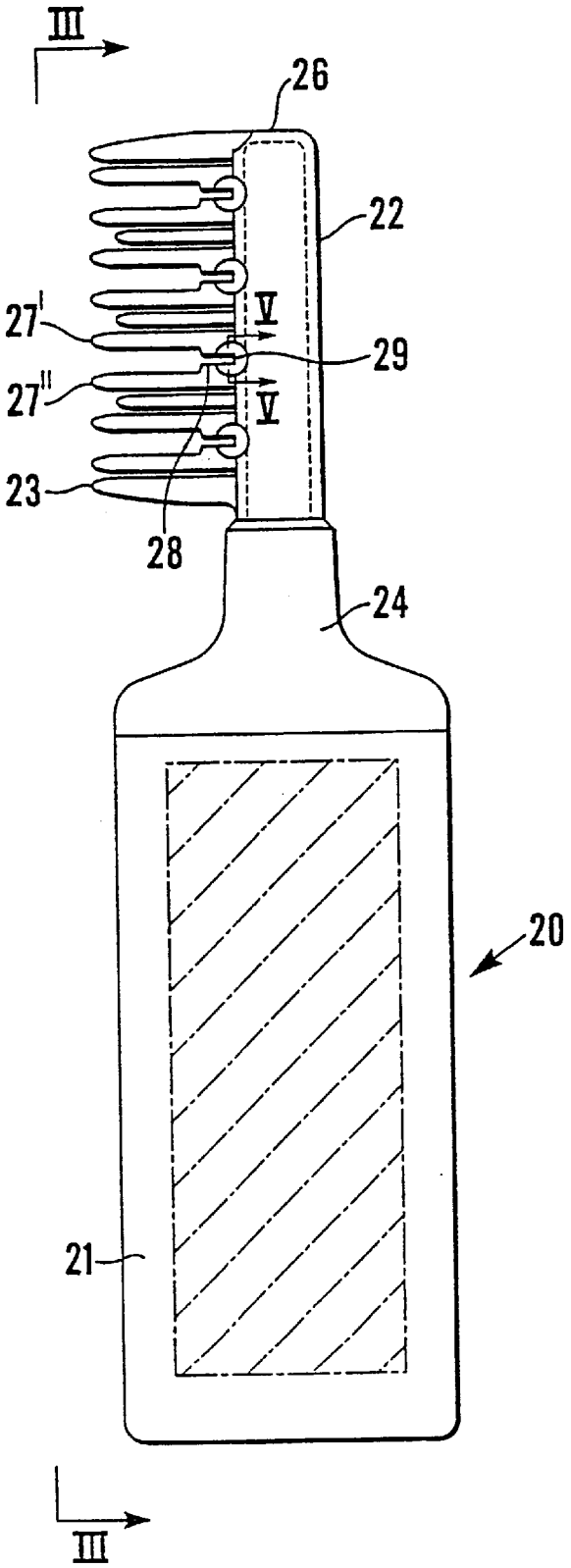
Figure 3:
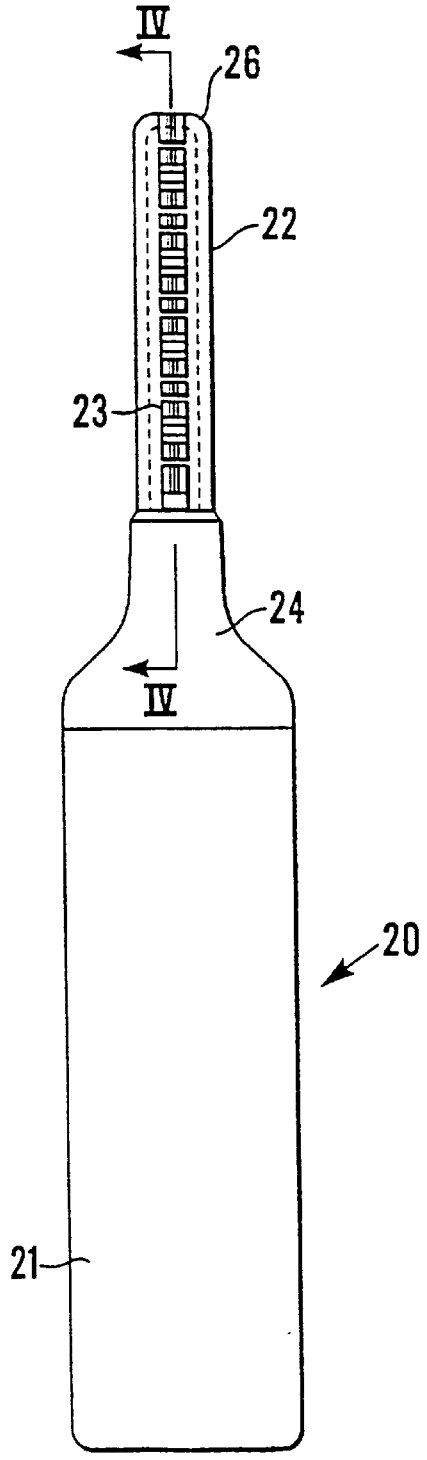
Figure 4A:
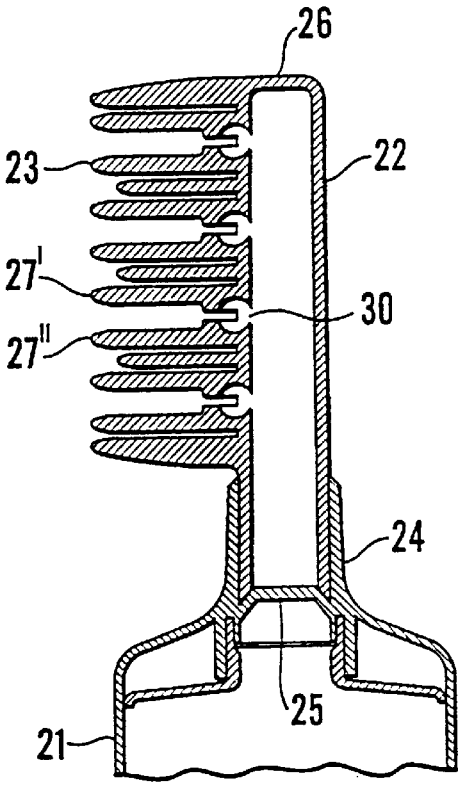
Figure 4B:
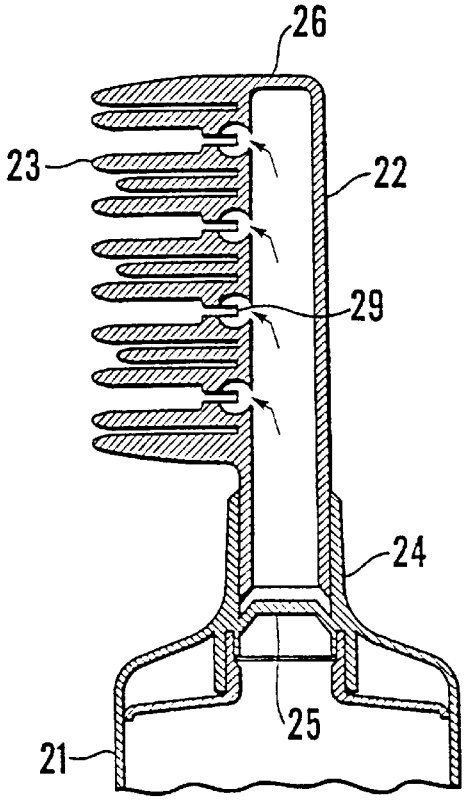
Figure 5:
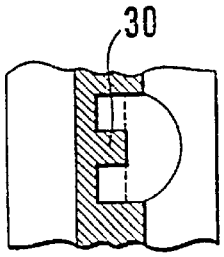

Preferred embodiments of the present invention will now be described with reference to the accompanying Drawings, in which:

FIG. 1 is an exploded view of a first embodiment of a comb in accordance with the invention, FIG. 2 is a side elevation, partly broken away, of a second embodiment of the invention, FIG. 3 is an underneath view taken on the line III—III of FIG. 2, FIGS. 4A and 4B each is a view taken on the line IV—IV of FIG. 3 showing valve means respectively in an open and in a closed condition, and FIG. 5 is a detail view taken on the line V—V of FIG. 2.

Referring first to FIG. 1, the comb 10 illustrated is conveniently made from the two parts 11 and 12 illustrated which are then joined along the median plane of the comb. When so assembled a row of relatively fine teeth 13 will project from one side of the root or stem 14,14A of the comb while a row of fewer, larger teeth 15,15A will project from its diametrically opposite side. The interior of the root or stem 14,14A is hollow and grooves 16,16' in half 14A of the stem, will, when it is assembled with half 14, provide two passageways communicating the interior of the stem with atmosphere at locations spaced along the length of the stem, each between a respective pair of the teeth 15,15A. It will be observed that the tooth component 15A of half 14A, unlike the tooth component 15 of half 14 of the comb, has circular formations 17,17' communicating with the respective passageways 16,16' and making a key-hole-like configuration with the associated pair of teeth 15A. When the two halves 14,14A of the comb are brought together these formations 17,17' will be closed on one side by the tooth component 15 so that the comb has laterally-presented concavities 17,17' each in communication with the hollow interior of the comb stem and of greater cross sectional area than the associated passageway 16,16'.

At its rear end 18 the comb assembly is adapted to be fitted releasably to one end of a cylindrical container (not shown) for a viscous liquid to be applied to hair by means of the comb. Conveniently the end of the container to which the comb is fitted carries a plunger or trigger assembly (not shown) whereby the content of the container can be manually pressurised to expel it into the comb interior. How this is achieved is not herein described and illustrated in more detail because the technology involved is well known per se, for example in tooth-paste dispensers, and does not form part of the present invention. Conveniently however the rear end formation 18 of the comb has on one side at least a large opening 19 through which the plunger or trigger is accessible to the forefinger of a hand holding the container and using it as a handle for the comb.

In use of the comb 10 illustrated it is fitted to a selected container, for example of highlighting gel, and the plunger or trigger is depressed or "pumped" until the concavities 17,17' fill with the gel but do not overflow. When the teeth 15,15A are now drawn through the hair two spaced-apart streaks of the gel will be applied to the hair. The well-like concavities 17,17' ensure that a sufficient volume of the gel is available and that it is exposed over a sufficient surface area while preventing it from dribbling or spreading, assuming that the operator is careful not to pump out more gel than is needed. It is easy for him to ensure this by visual inspection between successive strokes of the comb through the hair, because this will ascertain whether enough gel for a subsequent stroke remains in the concavities or wells 17,17'.

The row of finer teeth 13 is of course an optional feature giving the comb of the invention greater versatility in its uses and avoiding the need for a separate comb of similar characteristics.

The comb 20 illustrated in FIGS. 2–5 comprises a housing 21 for liquid which also serves as a handle for the comb. The comb proper comprises a hollow stem portion 22 from one side of which an array of teeth 23 projects. The stem has a closed distal end 26 and an open end which is telescopically received in a tubular formation 24 at one end of housing 21. Means (not shown) is provided for limiting relative movement of stem 22 and housing 21 so that the stem cannot be unintentionally removed from the housing. In a first, closed position illustrated in FIG. 4A the open end of stem 22 seats on a valve formation 25 of the housing to prevent liquid flowing from the interior of the housing into the interior of the stem 22. In a second, open position illustrated in FIG. 4B a pathway has been provided around the valve formation 25 whereby liquid may flow from the interior of housing 21 into stem 22.

The array 23 of teeth comprises four adjacent pairs such as 27',27" which are widely separated over their free end portions but relatively narrowly separated adjacent stem 22. Hair entering the relatively wide passage between these teeth is directed toward the narrow slot 28 and the latter "snatches" at the tress of hair, tending to remove dead hair. The teeth such as 27',27" are relatively wide on opposite sides of the narrow slot 28 and in these relatively wide areas of the teeth there is formed on one side only of the comb a part-spherical depression of well 29 Thus the comb illustrated has four wells 29 opening laterally thereof to one side only (the side viewed in FIG. 2) at the junctions between the teeth such as 27',27" which have unequal spacing and the stem 22. Each well 29 communicates with the interior of stem 22 by means of a square hole 30 in the latter.

In use of the comb illustrated stem 22 and housing 21 are pulled apart enabling the gel or liquid in housing 21 to fill stem 22 when the latter is tipped downward. The gel or liquid will then seep through holes 30 and fill the wells 29, where it will tend to be retained by surface tension.

The user can prevent excess gel or liquid overflowing the wells 29 to an undesirable extent by suitable manipulation of the comb. Likewise he or she can ensure that the wells 29 remain charged by periodically re-opening the passage between housing 21 and stem 22 and tipping the comb downwards.

Although primarily adapted for applying discrete streaks of highlighting gel to the hair the comb of the invention is not confined in its use to this purpose. It can also be used efficiently to apply other liquids such as conditioners to the hair simply by substituting a different container or housing 21.

What is claimed is:

1. A hairstyling comb comprising a stem from one side of which a plurality of generally parallel teeth extend, the stem being hollow and communicable with a reservoir for viscous liquid to be applied to the hair, and a fluid well opening generally laterally to one side only at the junction between the teeth, each fluid well being defined by an aperture in the comb stem into which fluid is supplied from the comb stem, the teeth of the comb spaced apart to provide a plurality of wider spacings at distal ends and narrower spacings at root ends, the wider spacings being capable of receiving strands of hair to be treated, each narrower spacing communicating with the fluid well.

2. A comb as claimed in claim 1, wherein one end of the stem is closed and the other end is adapted for releasable connection to said reservoir, the reservoir serving as a handle for the comb when attached to the stem.

3. A comb as claimed in claim 1 wherein the stem has an open end which is telescopically received in a tubular formation of the reservoir, the stem having limited movement relative to the reservoir between a position in which communication of the interior of the stem with the interior of the reservoir is closed off and a position in which a passageway is opened for the flow of fluid from the interior of the reservoir to the interior of the stem.

4. A comb as claimed in claim 1 wherein each fluid well is formed in root portions of a respective pair of adjacent teeth.

5. A comb as claimed in claim 4, wherein the teeth of each pair in which a fluid well is formed are more widely separated in distal end regions than in root end regions, and have a step formation to a relatively narrow slot between said teeth communicating with the well therein.

* * * * *